United States Patent [19]

Young

[11] 4,276,662

[45] Jul. 7, 1981

[54] PLUG DEVICE FOR DRAINPIPE OF BASIN OR BATHTUB

[76] Inventor: Victor Young, 3rd Fl., No. 4, Alley 31, Lane 41, Wu-Feng Rd., Hsin-Tien Town, Taipei Hsien, Taiwan

[21] Appl. No.: 83,981

[22] Filed: Oct. 11, 1979

[51] Int. Cl.[3] ..... A47K 1/14

[52] U.S. Cl. ..... 4/295; 4/287

[58] Field of Search ..... 4/295, 286, 191, 287, 4/194

[56] References Cited

U.S. PATENT DOCUMENTS

| | | | |
|---|---|---|---|
| 641,185 | 1/1900 | Borein | 4/295 UX |
| 1,107,363 | 8/1914 | Schmidt | 4/295 |
| 1,511,017 | 10/1924 | Binder | 4/287 |
| 1,630,351 | 5/1927 | Mortimer | 4/295 |
| 1,630,352 | 5/1927 | Mortimer | 4/295 |
| 2,450,392 | 9/1948 | Donahue | 4/287 |
| 2,479,485 | 8/1949 | Frank | 4/287 |
| 2,915,762 | 12/1959 | Kivela | 4/295 |
| 3,010,120 | 11/1961 | Young | 4/295 |
| 3,468,512 | 9/1969 | Politz | 4/295 X |
| 3,849,809 | 11/1974 | Morris et al. | 4/295 |
| 3,949,433 | 4/1976 | Liou | 4/295 |
| 4,007,500 | 2/1977 | Thompson et al. | 4/295 |

*Primary Examiner*—Henry K. Artis

*Attorney, Agent, or Firm*—Holman & Stern

[57] ABSTRACT

An improved plug device for the drain of a basin or a bathtub, which is comprised of a roller mounted on a rod and spring enclosed by two semicircular sleeves, which when assembled together form a cylindrical sleeve. The roller is guided by a guide groove which is carried on the inner wall of the two semicircular sleeves. The roller is connected to a drain plug by a rod and spring urges the device upwardly. The guide groove has rest positions so that by simply depressing the plug sequentially, the plug is automatically set in either the open or closed position.

4 Claims, 5 Drawing Figures

PLUG DEVICE FOR DRAINPIPE OF BASIN OR BATHTUB

BRIEF SUMMARY OF THE INVENTION

Prior art plugs for drains of basins or bathtubs are connected with chains which in the process of washing are easily hooked by a towel and the water is then discharged unexpectedly. In addition, chains are apt to split and rust and not only become an eyesore but also damage towels or clothes. After the chain splits, the plug is lost easily and hard to pull when water pressure is high.

This invention relates to an improved plug device for drains of basins or bathtubs, which mainly comprises a flexible plug, a rod, a roller, a spring, two semicircular sleeves, a threaded sleeve and several nuts. The drain orifice is alternatively closed by depressing a rod that causes a roller to move down along a guide groove, or opened by the resilience of a spring to raise the rod.

DETAILED DESCRIPTION

Figure 1:
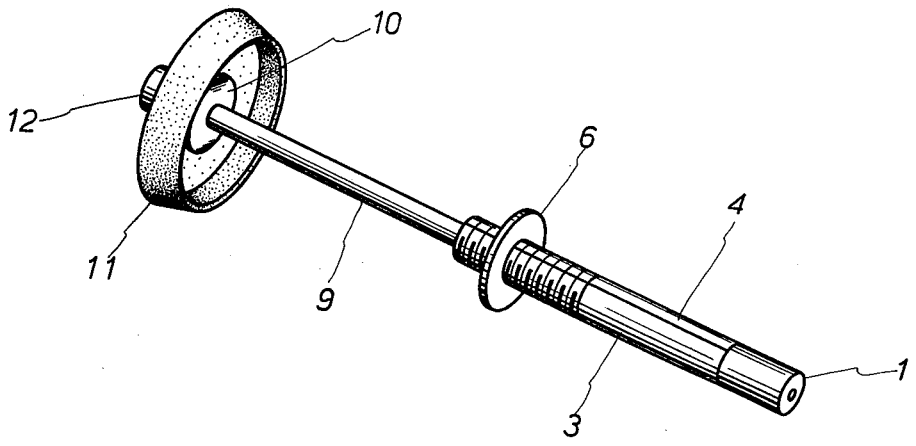
FIG. 1 is a perspective view showing this improved device.
Figure 3:
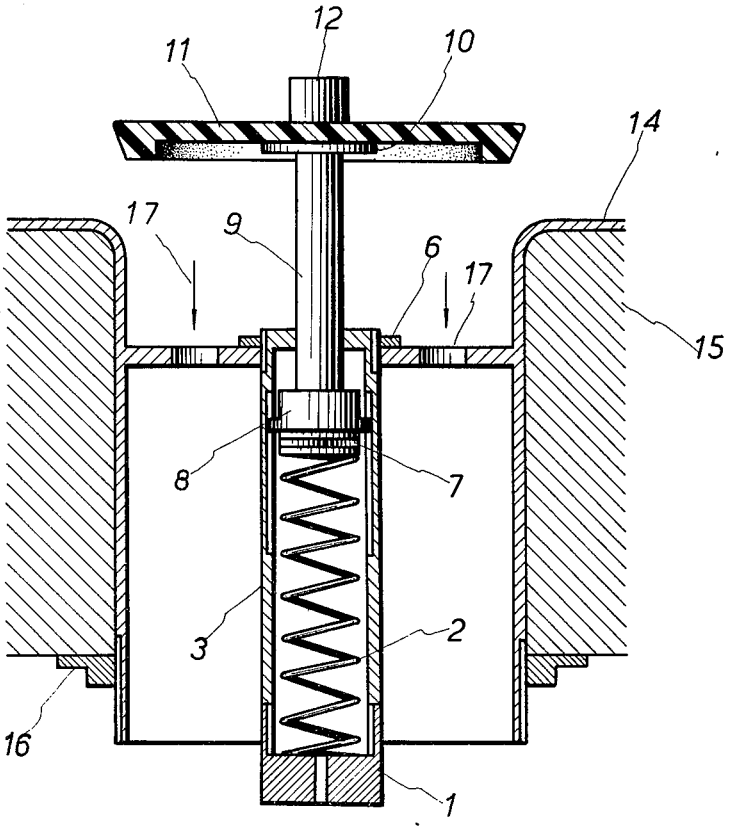
FIG. 3 is a longitudinal sectional view of the plug of this invention when in the open position.
Figure 4:
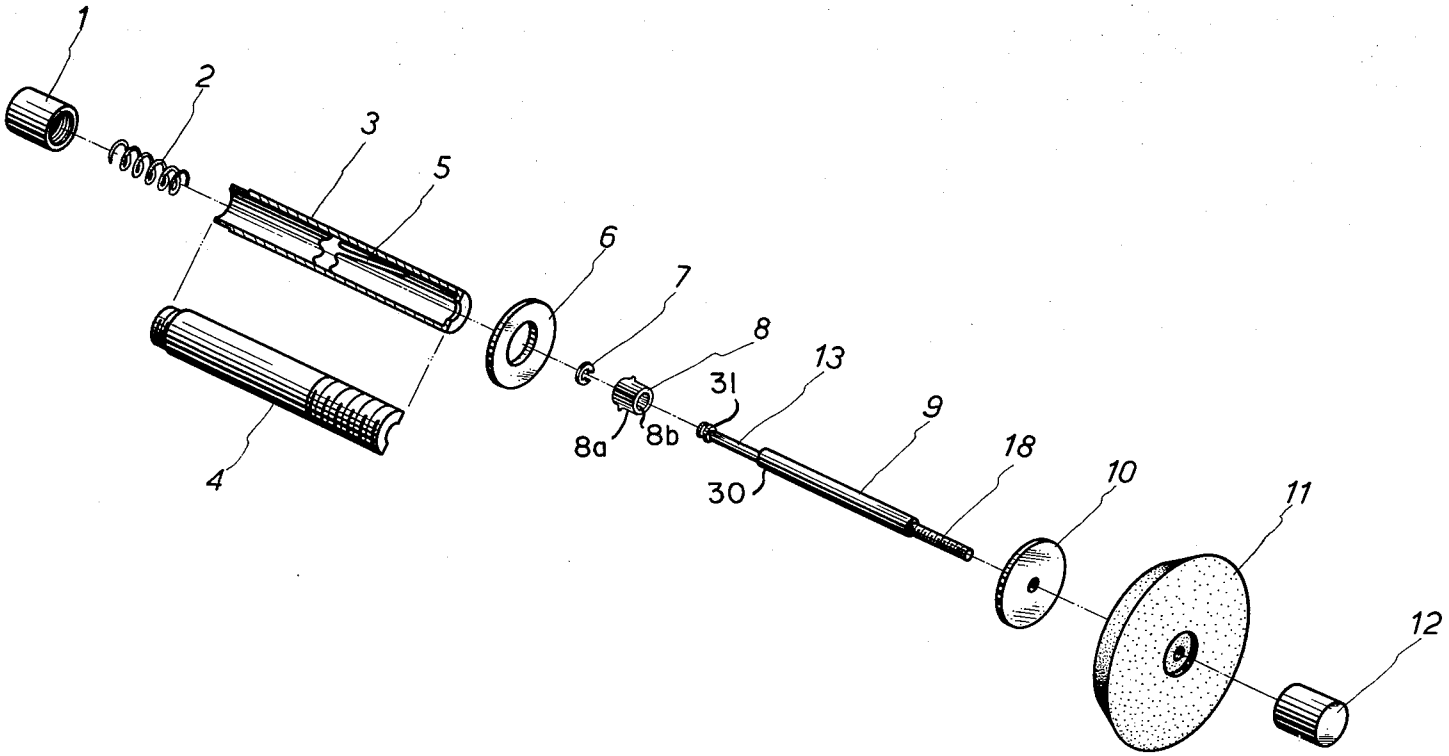
FIG. 4 is a perspective exploded view of the plug of this invention to illustrate inner structure.

This invention relates to an improved plug device for a drain of a water basin or bathtub. As shown in FIGS. 1 and 3, the plug includes a threaded sleeve 1, spring 2, two semicircular sleeves 3 and 4, a nut 6, a rod 9, a roller 8, a stopper nut 10, a flexible plug 11 and a grip nut 12. The opening and closing action is accomplished by the movement of roller 8 moving along camming guide grooves carved in the inner circumferential wall of the two semicircular sleeves 3 and 4.

Figure 5:
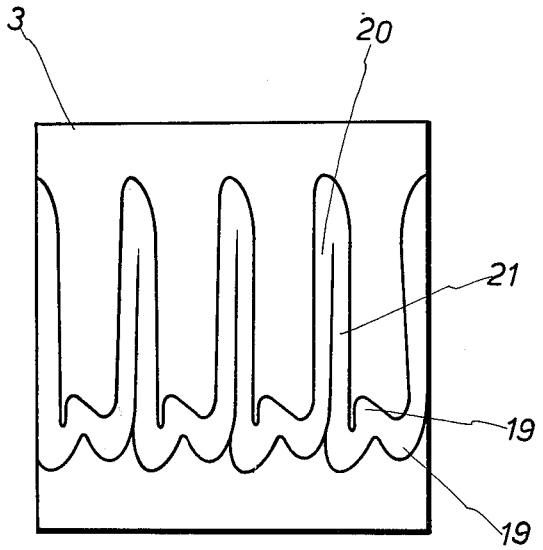
FIG. 5 is a longitudinal sectional view of the camming guide groove of this invention when the semicircular sleeve is unrolled.
Figure 2:
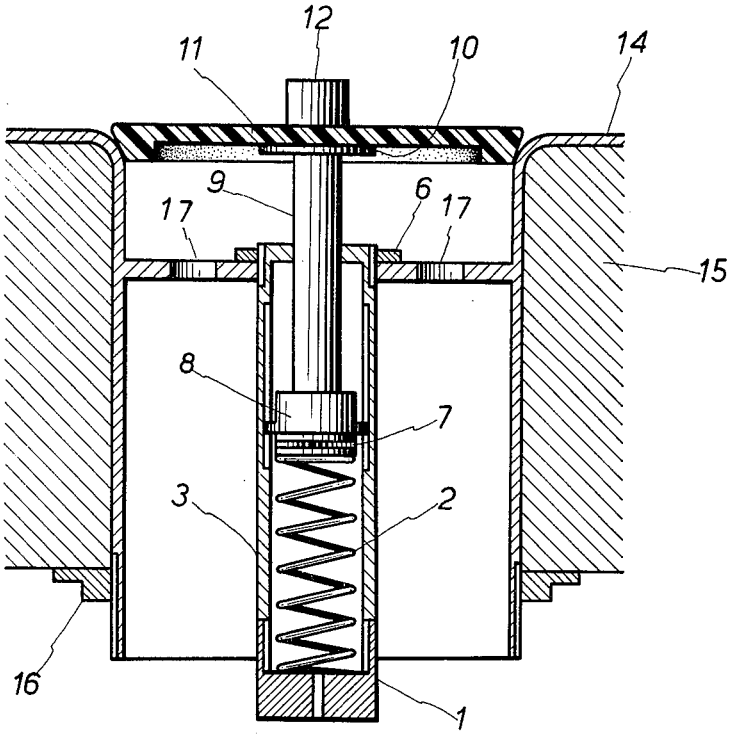
FIG. 2 is a longitudinal sectional view of the plug of this invention when in the closed position.

FIG. 2 represents a longitudinal sectional view of the plug device of this invention in the closed position when the basin contains water. The parts of the plug are assembled by inserting the reduced neck 13 on the lower end of rod 9 through the central hole 8*b* in roller member 8 until it abuts against shoulder 30 of rod 9. The end of reduced neck 13 is enlarged and has a circumferential slot 31 into which C-shaped retainer 7 is inserted to retain roller 8 on neck 13 rotatably. The semicircular sleeves 3 and 4 are next assembled together to form a hollow cylindrical member enclosing the lower end of rod 9 and roller 8. Roller 8 has two oppositely disposed protrusions or flanges 8*a* which are slidably engaged within the guide groove 5. Guide grooves 5 are cut into the inner circumferential walls of sleeves 3 and 4 so that when these sleeves are assembled the guide grooves form a continuous circumferential slot or groove in the inner wall of the cylindrical member. The configuration of the guide groove 5 is shown in FIG. 5 as it would appear if the sleeve member 3 or 4 were unrolled into a flat shape. The further details and functions of the guide groove will be described in connection with the operation of this invention hereinafter. Spring member 2 is then inserted into the lower end of the cylindrical member formed by semicircular sleeves 3 and 4 and internally threaded sleeve 1 is screwed onto cooperating external threads on the lower end of sleeves 3 and 4 to hold sleeves 3 and 4 together and retain spring 2 therein compressed at its upper end against the lower end of rod 9 to urge rod 9 upwardly. Nut 6 is also screwed onto cooperating screw threads on the upper end of sleeves 3 and 4 to hold them together. The upper ends of sleeves 3 and 4 have reduced sections which when assembled provide a bore slightly larger than the diameter of rod 9 so that rod 9 will slidably move therethrough. The flexible plug 11 is attached to the upper threaded end 18 of rod 9 by a nut 10 threaded on screw threads 18 which engage the lower face of plug 11 and a thumb nut 12 which also engages screw threads 18 and is tightened to slightly compress plug 18 between it and nut 10.

In use, the assembled plug device is inserted into the mesh of the drain orifice. To close the drain, flexible plug 11 is depressed to sealingly engage the opening. During this movement, from the position of FIG. 3 to FIG. 2, rod 9 carries roller 8 moving along guide groove 5 carved on the inner wall of two semicircular sleeves 3 and 4 against the force of the spring 2.

The operation of guide grooves 5 will now be described. With reference to FIGS. 2, 3 and 5, guide groove 5 in each of its substantially vertical legs is comprised of closely adjacent substantially parallel grooves 20 and 21. When in the upper open position, the protrusions 8*a* are cammed by curved surface 21*a* into position 20*a* above groove 20 so that when the plug is depressed manually they are guided through groove 20 until they reach the bottom curved camming surface 19*a* of turning groove 19. In this position, plug 11 is overflexed beyond that required to maintain a good seal at the drain opening, whereupon manual release of plug 11 will result in roller 8 being moved upwardly by spring 2 and the protrusions 8*a* being guided by curved camming surfaces 19*b* and 19*c* into the rest position 19*d* which holds the plug 11 in the closed position.

To open the drain, the plug 11 is again depressed manually whereupon protrusions 8*a* are guided by curved camming surfaces 19*e* to position 19*f* directly below guide groove 21. Upon release of the plug, spring member 2 then drives rod 9 and roller 8 upwardly with the protrusions 8*a* being guided by groove 21 until they reach camming surface 21*a* which guides them into the top rest position 20 where the plug 11 is in the open position.

From this, it will be seen that the drain can be opened and closed with applicant's invention by merely manually depressing the plug member sequentially, the guide grooves 5 and cooperating protrusions on roller 8 functioning to automatically set the plug in either position ready for movement to the other position.

What I claim is:

1. A drain plug device for a basin or bathtub comprising a flexible plug fixed to the upper end of a rod, a roller member rotationally mounted on the lower end of said rod, a tubular sleeve member telescopingly engaging said roller member therewithin for relative rotational and slidable movement, a spring member within said tubular sleeve for urging said roller member and rod upwardly, means to attach said device within the drain opening, cooperating means on said roller member and the inner surface of said tubular sleeve which by depressing said plug member only cooperates to fix said plug in position to open or close the drain.

2. The drain plug device as recited in claim 1, wherein said cooperating means comprises a guide groove on the inner circumferential surface of said tubular sleeve, at least one radially outwardly extending protrusion on the outer surface of said roller member slidably engaging within said groove, said groove having open or closed rest positions and camming surfaces which guide each said protrusion into said rest positions after each depression of said plug to open or close the drain.

3. The drain plug device as claimed in claim 2, wherein two radially oppositely disposed protrusions are provided on said roller member which engage within oppositely disposed sections of said groove, said groove being continuous and having a plurality of substantially vertical downward sections through which said protrusions slide downwardly, camming surfaces at the lower ends of said vertical sections which turn said roller and guide said protrusions into said closed rest position, a plurality of substantially vertical upward sections substantially parallel to said downward sections through which said protrusions slide upwardly, camming surfaces between the lower end of said upward sections and a position below said closed rest position to guide said protrusions therebetween upon depressing said plug, and camming surfaces at the upper ends of said upward sections to guide said protrusions into the open rest position of said plug above said downward section by the force of said spring.

4. The drain plug device as claimed in claim 3, wherein said tubular sleeve is comprised of two semicircular members having external screw threads at each end, an internally threaded sleeve member threadily engaging the lower end of said tubular sleeve and a nut threadedly engaging the upper end of said tubular sleeve member to retain said semicircular members together, said internally threaded sleeve member retaining said spring within said tubular member.

* * * * *